United States Patent [19]

Nakanishi et al.

[11] Patent Number: 4,878,088

[45] Date of Patent: Oct. 31, 1989

[54] DEVELOPING UNIT OF ELECTROPHOTOGRAPHIC APPARATUS

[75] Inventors: Akio Nakanishi, Funabashi; Toshio Hino, Tokyo; Yoshio Iino, Yokohama; Kazuhisa Suetani, Kawasaki; Yoji Houki, Tokyo; Hirotoshi Ikuta, Yokohama, all of Japan

[73] Assignee: Fujitsu Limited, Kawasaki, Japan

[21] Appl. No.: 880,920

[22] Filed: Jul. 1, 1986

[30] Foreign Application Priority Data

Jul. 2, 1985 [JP] Japan ..... 60-145087
Sep. 12, 1985 [JP] Japan ..... 60-140011[U]

[51] Int. Cl.[4] ..... G03G 15/08

[52] U.S. Cl. ..... 355/244; 355/253; 355/259; 118/653

[58] Field of Search ..... 355/300, 14 D, 3 R; 118/657, 653; 420/120, 121, 122

[56] References Cited

U.S. PATENT DOCUMENTS 4,426,148 1/1984 Ikemoto et al. ..... 355/3 DD
4,583,843 4/1986 Ohata et al. ..... 355/14 D X
4,592,653 6/1986 Ikeda et al. ..... 355/14 D X
4,666,283 5/1987 Iida et al. ..... 355/14 D X

FOREIGN PATENT DOCUMENTS 125497 11/1984 European Pat. Off. .
125606 11/1984 European Pat. Off. .
131957 1/1985 European Pat. Off. .
161795 11/1985 European Pat. Off. .
2737147 2/1978 Fed. Rep. of Germany .
3314134 10/1983 Fed. Rep. of Germany .

OTHER PUBLICATIONS

European Search Report dated 1/27/87.

*Primary Examiner*—A. C. Prescott
*Attorney, Agent, or Firm*—Staas & Halsey

[57] ABSTRACT

A developing unit of an electrophotographic apparatus is provided for developing an electrostatic latent image formed on an image forming member, by electrostatically adsorbing powder developer onto the latent image. The developing unit includes a screw provided with paddles or grooves, each having a helix angle with respect to an axis of the screw, the screw transferring and supplying the powder developer stored in a developer reservoir to the developing roller; a blade for regulating a layer thickness of the powder developer to be transferred to the image forming member; and a flow regulating plate for biasing a flow of the powder developer, which has been removed by the blade and returned to the developer reservoir due to the force of gravity, in a direction opposite to a direction in which the powder developer is transferred by the screw. The developing unit further includes a structure for accurately positioning and maintaining the developing roller within a specified distance from the image forming member, thereby improving the uniformity of the developer concentration.

14 Claims, 24 Drawing Sheets

DEVELOPING UNIT OF ELECTROPHOTOGRAPHIC APPARATUS

BACKGROUND OF THE INVENTION

The present invention relates to a developing unit for a recording apparatus such as a copying machine and and electrophotographic printer.

An electrophotographic recording apparatus generally includes, as its principal components: a photosensitive drum having an image forming member made of, for example, a photosensitive layer of amorphous selenium formed on a metallic cylindrical surface; an electrification unit for uniformly electrifying the surface of the photosensitive drum by corona discharge, for example in order, to photosensitize the photosensitive drum; an exposing unit to form an electrostatic latent image on the surface of the photosensitive drum, thus photosensitized by irradiating a laser beam modulated by information to be recorded; a developing unit for developing the electrostatic latent image, which has been formed by the exposing unit using toner; a transferring unit for transferring the toner image formed by the developing unit to paper; and a fixing unit for fixing the toner image, which has been transferred to the paper by the transferring unit through for example, a heat melting process.

In the developing unit having the above arrangement, the toner having an electric charge of an opposite polarity to that of the electrostatic latent image formed on the photosensitive drum is adsorbed electrostatically to the latent image. Generally, a powder toner is used which is mixed with for example an iron powder, called the "carrier", to provide the powder toner with the electric charge. This mixture is known as a "two-component developer" or simply a "developer". When the toner and carrier are mixed in the developing unit, frictional electrification occurs which is used to provide the electric charge for the developer.

Generally, a mixing ratio of the toner (toner concentration) is expressed by weight percentage, and is, for example, 4%. Since the toner concentration is gradually decreased during use, the toner concentration must be observed and toner supplied when the toner concentration reaches a predetermined limit.

In an electrophotographic recording apparatus which allows the use of several kinds of paper having different widths, the toner concentration in the developing unit becomes non-uniform in a paper width direction if paper having a width narrower than the maximum recordable width are used for a long time, and subsequently if a paper having a width wider than the width of the narrower paper is used, a difference in the recording density will occur in a paper width direction of the wider paper.

Therefore, particularly in a recording apparatus which uses papers of different widths, a means must be provided to solve the non-uniformity of toner concentration in the paper width direction.

SUMMARY OF THE INVENTION

In order to solve the nonuniformity of toner concentration, the applicant of the present invention first considered the following structures.

FIG. 3 is a partial perspective view showing the first structure considered by the present applicant. The numeral 1 represents a casing; 2 a developer reservoir provided at the bottom of casing 1; 3 a paddle roller (stirring roller) provided with fins (paddles) extending parallel in an axial direction and rotating in a direction indicated by an arrow mark A to scoop developer contained in the developer reservoir 2 in a circumferential direction; 4 a developing roller rotating in a direction indicated by an arrow mark B to transfer the developer scooped by the paddle roller 3 to a photosensitive drum 5 which is an image forming member; 6 a blade for regulating a layer thickness of the developer to be transferred to the photosensitive drum 5 by the developing roller 4; and 7 a guide plate for separating the developer removed by the regulation of the blade 6 in a direction indicated by an arrow mark C and for returning the developer to the developer reservoir 2.

The guide plate 7 is provided with a plurality of fins 7*a* each being inclined with respect to an axis of the developing roller 4.

When the developer removed by the blade 6 is returned to the developer reservoir 2 by the guide plate 7, the returning developer is diffused in an axial direction of the developing roller 4 so that the concentration of the developer may become uniform.

FIG. 4 is a perspective view showing an essential portion of a second structure considered by the present applicant. In the figure, a side plate 7′ is similar in slope to the guide plate 7 of the first structure described above, but the inclination of each fin 7*a* (the setting position is indicated by an alternate long and short dash line) is larger than that of the fin of the first structure. Accordingly, the developer returning to the developer reservoir 2 is biased further in a direction indicated by an arrow mark D. In addition, a drop hole 7*b* is provided at an end of the guide plate 7′. The numeral 8 represents a screw conveyer for transferring the developer falling from the drop hole 7*b* in a direction indicated by an arrow mark E. The screw conveyer includes a screw 8*a* and a sleeve 8*b*.

In the second structure, the developer which has been removed by the blade 6 (FIG. 3) and returned to the developer reservoir 2 is biased in an axial direction of the developing roller 4 by the fins 7*a* and also is dropped from the drop hole 7*b* to a biasing end and fed back to the other end, thereby preventing the developer from accumulating at the biasing end, and at the same time, making the concentration of developer uniform.

The first structure is effective in eliminating the local non-uniformity of developer in an axial direction of the developing roller 4, but is not fully able to eliminate the non-uniformity of developer concentration caused by the use of paper having different widths.

The second structure also is less than fully satisfactory because deterioration of developer is quickened to shorten its service life because the screw conveyer 8 provides a stress on the developer, and the manufacturing cost is unavoidably increased because there are many parts.

Therefore, an object of the present invention is to provide a low-cost developing unit which can greatly eliminate the non-uniformity of the concentration in an axial direction of the developing roller without quickening the deterioration of developer.

A further object of the present invention is to create a positioning structure for a developing roller of an electrophotographic recording apparatus, which has an image forming member and a developing roller, wherein the positioning structure is used to create a highly accurate gap between the image forming member and the developing roller.

For example, a laser printing includes, as its principal components: an image forming member (photosensitive drum) having a photosensitive layer of amorphous selenium formed on a metallic cylindrical surface; an electrification unit for uniformly electrifying the surface of the image forming member by corona discharge, for example, to provide photosensitivity thereto; an exposing unit to form an electrostatic latent image on the surface of the image forming member given the photosensitivity by irradiating a laser beam modulated by information to be recorded; a developing unit for developing the electrostatic latent image formed by toner; a transferring unit for transferring the toner image formed by the developing unit to a recording paper; and a fixing unit for fixing the toner image which has been transferred to the recording paper by the transferring unit.

In the developing unit, the toner is given an electric charge of an opposite polarity to that of the electrostatic latent image formed on the image forming member and is adsorbed electrostatically to the latent image to obtain the toner image. The toner is used in the form of a mixture (the "two-component developer" discussed above) in which the toner is mixed with the "carrier", or it is used by itself (called the "one-component developer") with magnetism provided. To supply the developer to the image forming member, a developing roller is provided in the developing unit. A layer having a certain thickness of the developer is formed at the periphery of the developing roller, by utilizing the magnetic action, and the developing roller is rotated to touch the image forming member.

As mentioned above, the toner is adsorbed from the developing roller onto the electrostatic latent image formed on the image forming member by electrostatic action. As known in the art this adsorbing force is inversely proportional to the distance between the roller and the image forming member, squared.

Therefore, a gap between the image forming member and the developing roller must be precisely maintained at a designated value.

To maintain the gap between the image forming member and the developing roller at a predetermined distance, the following structure has been adopted according to the prior art.

In a first prior art example, a casing of the developing unit abuts a casing of the recording apparatus proper.

In a second prior art example, a pair of roller bearings is provided in the casing of the developing unit, and the roller bearings are caused to touch the peripheries of both ends of the image forming member respectively.

In a third prior art example, roller bearings are coaxially disposed at both ends of the developing roller, and the peripheries of the roller bearings are caused to touch the peripheries of both ends of the image forming member.

The above-mentioned prior art examples have several problems:

In the first prior art example, errors in fitting dimensions of the developing roller with respect to the casing of the developing unit, a dimensional error of an abutting portion on the developing unit casing side, a dimensional error of an abutting portion on the recording apparatus proper casing side, and errors in fitting dimensions of the image forming member with respect to the recording apparatus proper casing accumulate to increase an error in the gap between the image forming member and the developing roller.

In the second and third art examples, the gap between the image forming member and the developing roller may change due to the adhesion of the toner.

Therefore, a still further object of the present invention is to accurately maintain the gap between the image forming member and the developing roller.

According to the present invention, there is provided a developing unit for developing an electrostatic latent image formed on an image forming member, by electrostatically adsorbing powder developer which is transferred by a developing roller onto the latent image, including: a screw provided with paddles or grooves, each having a helix angle with respect to an axis of the screw, the screw transferring the powder developer stored in a developer reservoir toward an axis of the developing roller and to the circumference thereof to supply the powder developer for the developing roller; a blade for regulating a layer thickness of the powder developer to be transferred to the image forming member by the developing roller; and a flow regulating plate for biasing a flow of the powder developer, which has been removed by the blade and returned to the developer reservoir due to the force of gravity, in a direction opposite to a direction in which the powder developer is transferred by the screw.

Namely, the developing unit according to the present invention is a dry-type developing unit using a powder developer and will improve the recording quality by creating a uniform concentration of the powder developer received in the developing unit.

Further, the present invention provides a developing unit adapted for an electrophotographic recording apparatus, having means for positioning a developing roller which is an essential component of the developing unit, wherein the recording quality is improved by maintaining the positional accuracy of the developing roller with respect to an image forming member.

BRIEF DESCRIPTION OF THE DRAWINGS

These and other objects and features of the present invention will become apparent from the following description with reference to the accompanying drawings, in which.

DETAILED DESCRIPTION OF THE PREFERRED EMBODIMENTS

Figure 1:
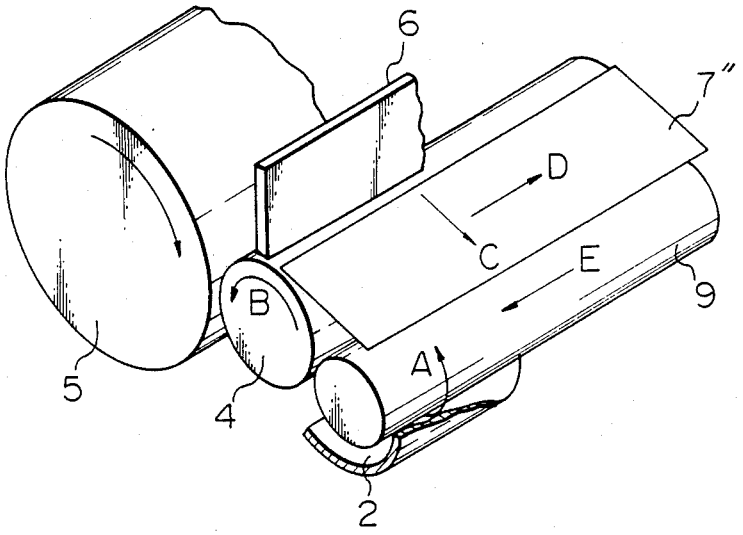
FIG. 1 is a partial perspective view of the present invention.

FIG. 1 is a partial perspective view showing the principles of the present invention. In the figure, the numeral 9 represents a screw provided with paddles or grooves each having a helix angle with respect to the axis of the screw, the screw 9 transfers powder developer stored in a developer reservoir 2 toward the developing roller 4 (an arrow mark E) and to the circumference thereof (an arrow mark A) to supply the powder developer for the developing roller 4. A flow regulating plate 7 is utilized for biasing a flow (an arrow mark C) of the powder developer, which has been removed by the blade 6 and moved due to the force of gravity, in a direction (an arrow mark D) opposite to a direction (the arrow mark E) in which the powder developer is transferred by the screw 9. The flow regulating plate 7" is provided with a plurality of biasing fins each of which is inclined with respect to the axis of the screw 9 as will be described later.

The the developer stored in the developer reservoir 2 is transferred in the direction of arrow mark A to the developing roller 4, and the developer, biased in the direction of arrow mark D by the flow regulating plate 7", is fed back in the direction of arrow mark E.

Figure 2:
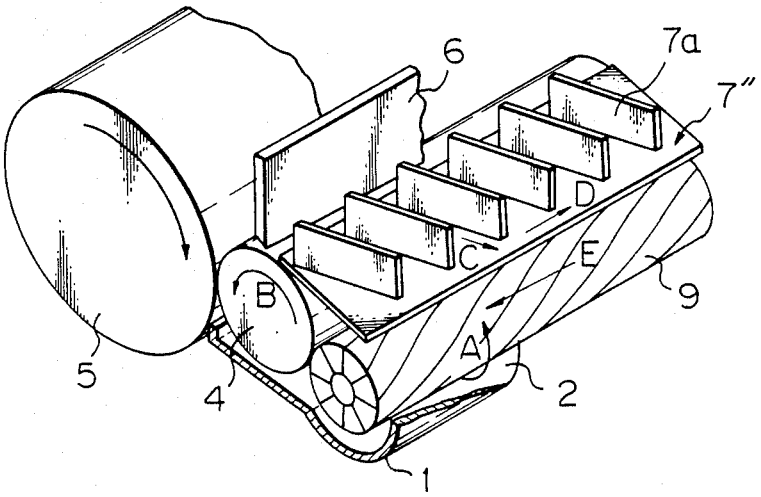
FIG. 2 is a partial perspective view showing an embodiment of the present invention.

FIG. 2 is a partial perspective view showing an embodiment according to the present invention. A screw 9 is provided with a plurality of paddles, each having a helix angle with respect to an axis of the screw 9. The screw 9 rotates in a direction indicated by an arrow mark A to transfer the powder developer, stored in developer reservoir 2, in a direction indicated by the arrow mark E and in a direction indicated by an arrow mark A toward the circumference of a developing roller 4, to supply the powder developer to the developing roller 4.

Figure 3:
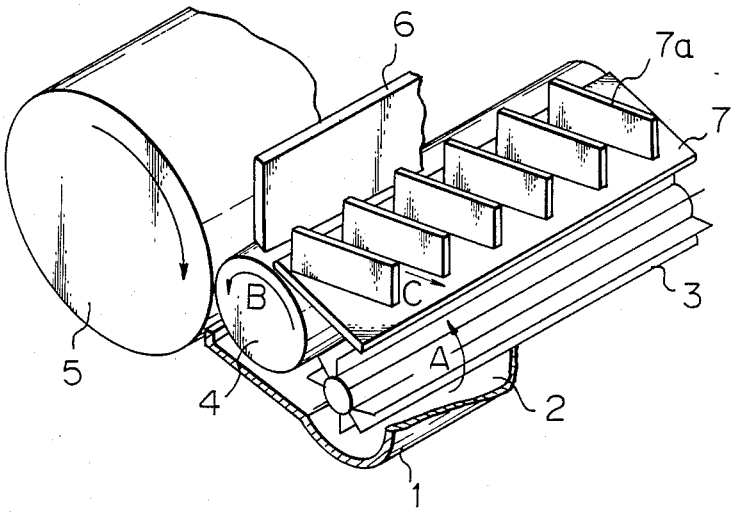
FIG. 3 is a perspective view partly broken an earlier version of the applicant's development.
Figure 4:
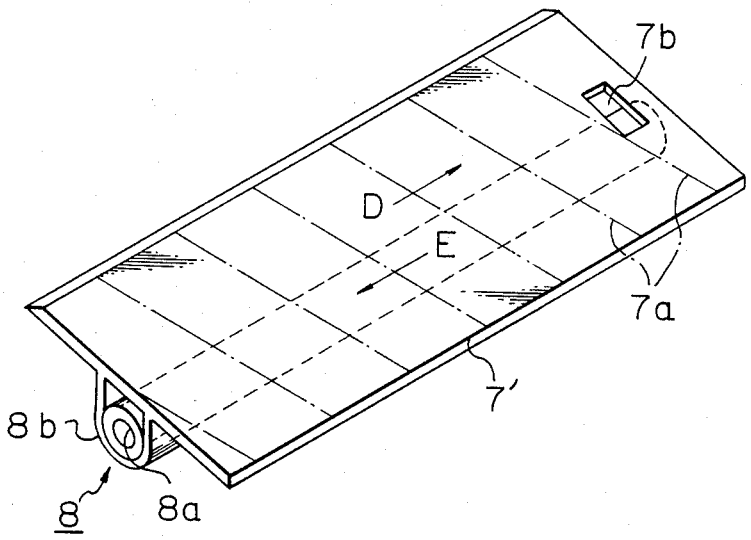
FIG. 4 is a perspective view showing another earlier version of the applicant's development.

A flow regulating plate 7" is provided with a plurality of fins 7a, each being inclined with respect to the axis of the developing roller 4 similar to the guide plate 7 shown in FIG. 3. As a result, the developer which has been removed by the regulation of a blade 6 and returned to the developer reservoir 2 is biased in a direction indicated by an arrow mark D.

As described above, the screw according to the present invention has both the functions of an paddle roller and a screw conveyor, and reduces a stress given to the developer by circulating the developer in the developer reservoir 2.

As a result, a non-uniformity of the concentration of developer in an axial direction of the developing roller will be greatly reduced without quickening the deterioration of the developer and without increasing the number of parts.

Figure 5:
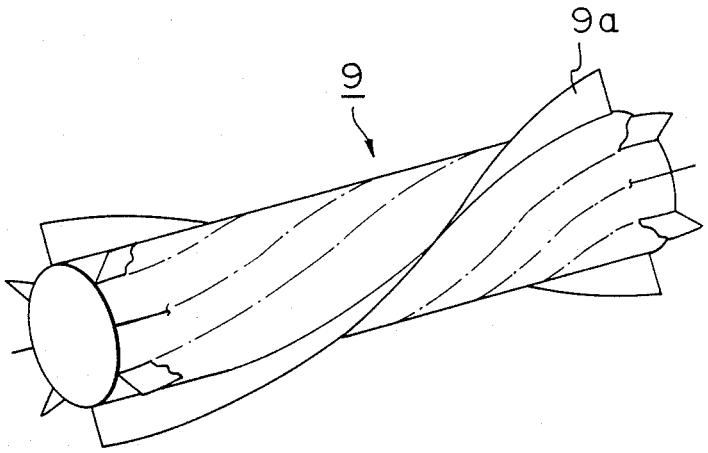
FIG. 5 is a perspective view showing a screw according to the present invention.

FIG. 5 is a perspective view showing the screw according to the present invention. In this embodiment, the screw 9 is provided with eight paddles 9a, each of which is twisted by 180° for the total length (about 28 cm) of the screw 9.

Figure 6:
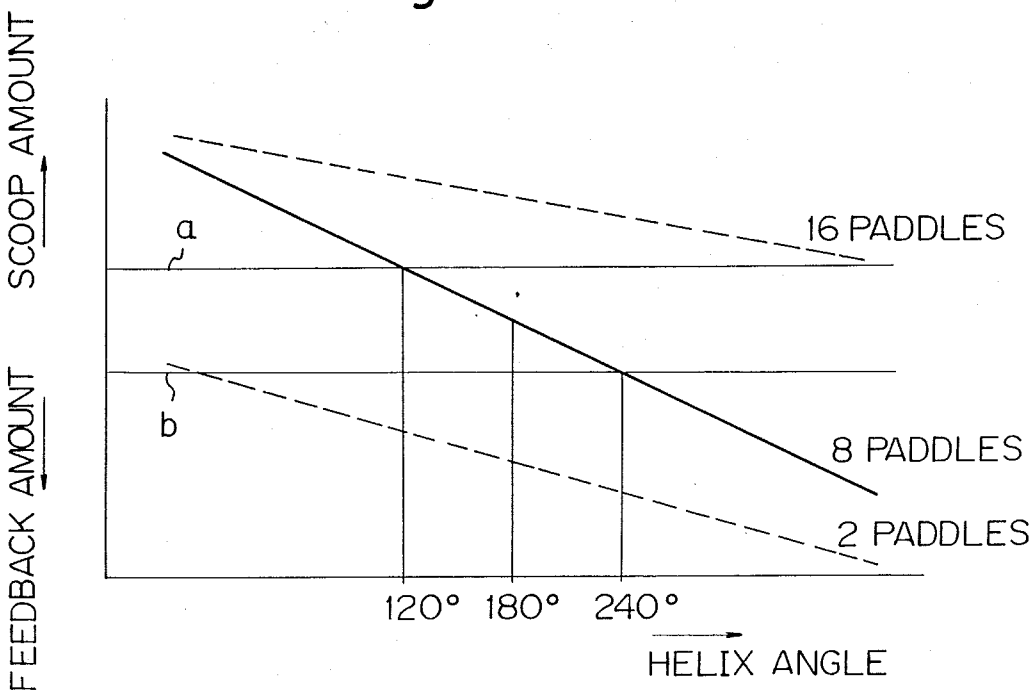
FIG. 6 is a graph for determining an optimum number of screws.

FIG. 6 is a graph showing the relationship between helix angles and transferring forces in a circumferential direction and in an axial direction of the screw with respect to the change of the number of paddles of the screw. The vertical axis indicates a circumferential transferring amount (the higher the vertical axis, the larger the amount) of the toner which is scooped by the screw and supplied to the developing roller as well as an axial transferring amount (the lower the vertical axis, the larger the amount) of the toner which is returned in an axial direction of the screw after the toner is fed back from the developing roller. The horizontal axis indicates helix angles. In this case, each helix angle value indicates the degree of twist of each paddle with respect to the whole length of the screw, which is about 28 cm, similar to the whole length of the developing roller. An area between straight lines "a" and "b" shown in the graph is the one in which the helix angle is balanced with the transferring amounts in the circumferential and axial directions. Namely, this area will be defined as follows:

If a single paper having a width which is the same as the total axial length of the developing roller is printed after printing 1000 papers, each having a width of a half of the total axial length of the developing roller, a difference in printed density between a portion of the single paper which has been printed by one half of the developing roller, used for printing the 1000 papers, and the other portion of the single paper which has been printed by the other half of the developing roller not used for printing the 1000 papers is within 0.2 inches of the to outer diameter.

In the area between the lines "a" and "b", the toner is stirred uniformly for the whole length of the developing roller, and the difference in printing density is so small that it can be ignored in practical use. As apparent from the graph, an optimum structure is realized with eight paddles each having a helix angle of 180°.

Figure 7:
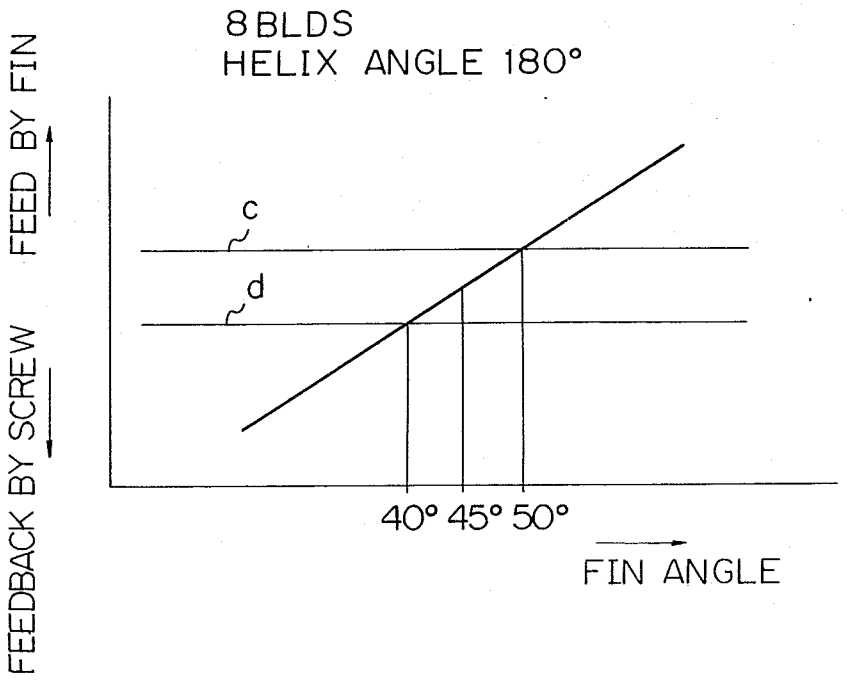
FIG. 7 is a graph for determining an optimum helix angle of each fin of the screw.

FIG. 7 is a graph showing a balance between a biased transferring amount of the fins for biasing the toner returned from the developing roller, and an axial transferring amount of the screw which transfers the toner in a direction opposite to the biased direction, with respect to an inclination angle of each fin. An area between straight lines "c" and "d" shown in the graph is the one which the balance between the transferring amounts of the fins and the screw becomes optimum, and the toner is uniformly distributed over the developing roller. The graph has been prepared subject to a screw with eight paddles each having a helix angle of 180°. As apparent from the graph, an optimum inclination angle of each fin is 40° to 50°.

Positioning means for arranging a developing roller precisely parallel with an image forming member (photosensitive drum) will now be hereunder.

Figure 8:
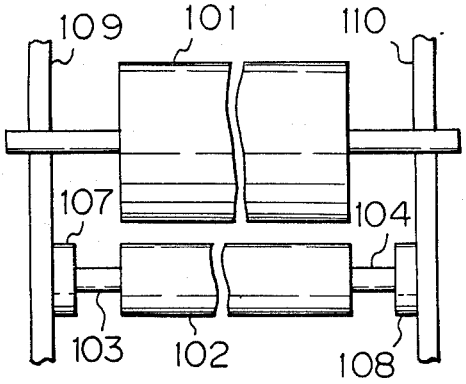
FIG. 8 is a front view of the means for positioning the developing roller of the present invention.

FIG. 8 is a view showing the principle of the present invention, in which the numeral 101 represents an image forming member; 102 a developing roller; 103 a first supporting member disposed at one end of a shaft of the developing roller 102; 104 a second supporting member disposed at another end of the shaft of the developing roller 102; 109 and 110 a pair of holding members (side frames) for holding the image forming member 101; 107 a first fitting member which is fixed to one (109) of the holding members to fit the first supporting member 103 thereto; and 108 a second fitting member which is fixed to the other holding member 110 to fit the second supporting member 104 thereto.

Namely, the accumulation of dimensional errors will be reduced by providing only two members, i.e., the holding member 109 (or 110) and the fitting member 107 (or 108) interposed between the image forming member 101. The developing roller 102, and the periphery of the image forming member 101, to which the developer tends to adhere, is not used for the positioning, thereby improving the accuracy of a gap between the image forming member 101 and the developing roller 102.

Figure 9A:
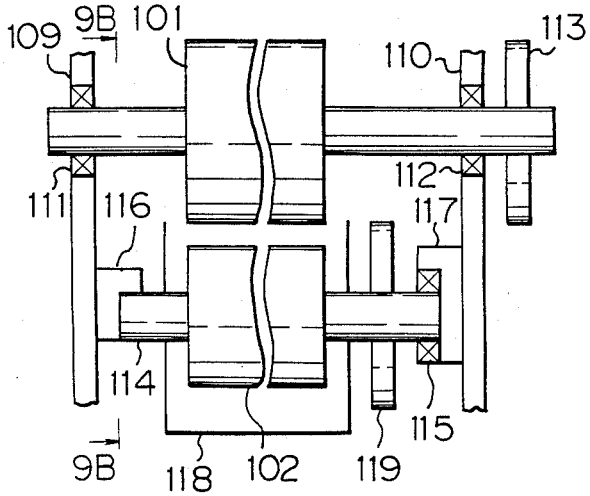
FIGS. 9(A) and 9(B) are front and side views respectively, of an embodiment of the positioning means according to the present invention.
Figure 9B:
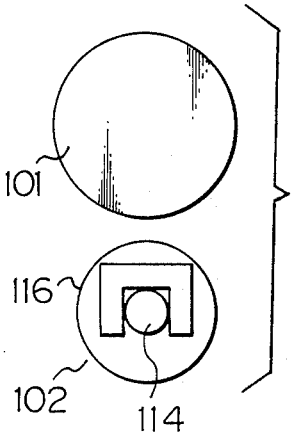

FIG. 9(A) is a front view of the positioning means and FIG. 9(B) a side view thereof taken along the arrow marks 9B—9B of FIG. 9(A). In this embodiment, the present invention is applied to a rotary sleeve type magnetic developing roller. In the FIGS. 9(A) and 9(B), the reference numerals shown in FIG. 1 represent like parts, and further: the numerals 111 and 112 represent roller bearings fixed to holding members 109 and 110 to support a rotary shaft of an image forming member 101; 113 is a pulley provided at on end of a shaft of the image forming member 101; 114 a shaft provided on a stationary magnet side, the shaft 114 being a first supporting member on one side of a shaft of a developing roller 102; 115 a roller bearing provided on a rotary sleeve side, the roller bearing 115 being a second supporting member on the other side of the shaft of the developing roller 102; 116 a first stopper fixed to the holding member 109, the first stopper 116 being a fitting member to fit the shaft 114; 117 a second stopper fixed to the holding member 110, the second stopper 117 being a fitting member to fit the roller bearing 115 thereto; 118 a developing unit casing; and 119 a driving gear for driving a sleeve of the developing roller 102.

In the above arrangement, the image forming member 101 is supported by a pair of the holding members 109 and 110 through the high-precision roller bearings 111 and 112.

Therefore, by fixing the first and second stoppers 116 and 117 to a pair of the holding members 109 and 110 by precision positioning pins, for example, the developing roller 102 can be positioned with a high accuracy with respect to the image forming member 101.

Since the shaft 114 and the roller bearing 115 are disposed outside the developing unit casing 118, they will not be contaminated by the developer.

As described above, the present invention can maintain a gap between the image forming member and the developing roller with a high accuracy so that the recording quality will be stabilized for a long time.

Figure 10:
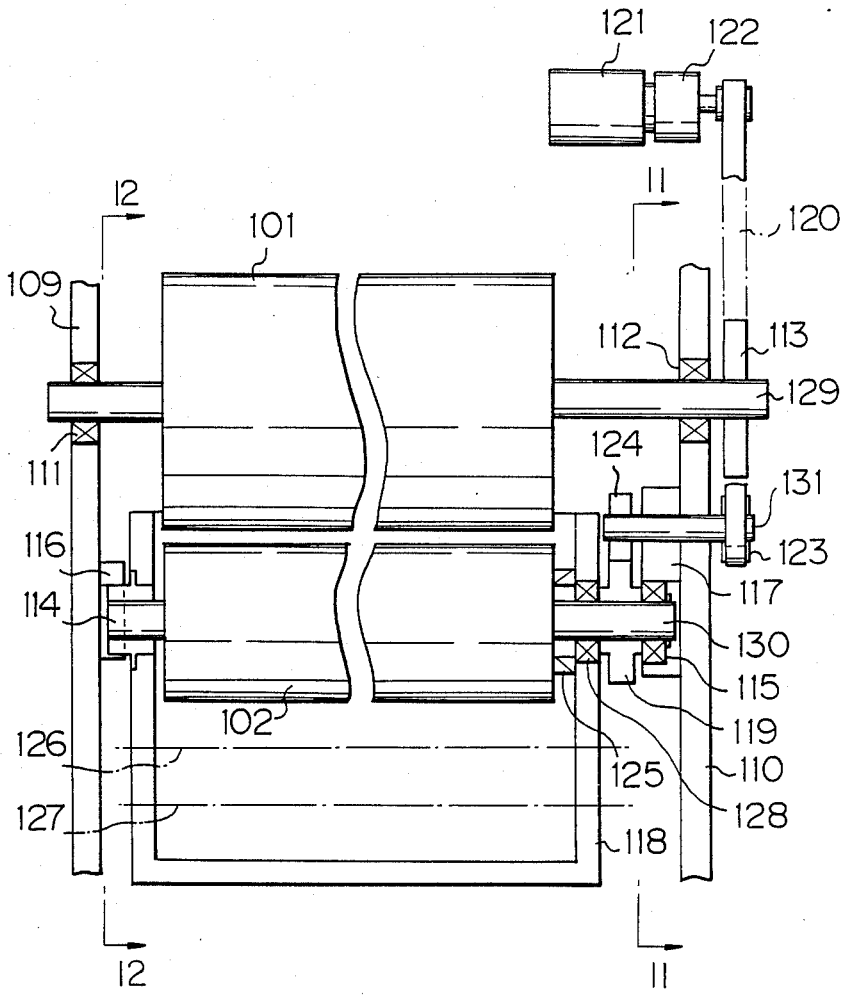
FIG. 10 is a top view showing the positioning means of the present invention.
Figure 11:
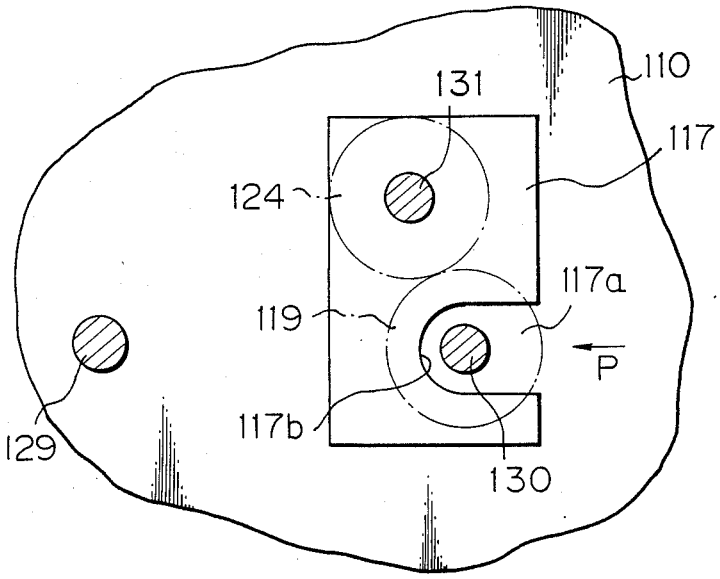
FIG. 11 is a view taken along the arrow marks 11—11 shown in FIG. 10.

FIG. 10 is a top view showing in detail the positioning structure according to the present invention. The developing unit casing 118 accommodates the developing roller 102, a stirring roller 126 including the above-mentioned screw, and a toner supplying roller 127 for supplying the toner from a hopper (not shown), located above the casing 118, to the casing 118. The shaft 114 of the developing roller 102 is fixed to a magnetic roller (to be described later) disposed inside the developing roller 102 and not rotatable with respect to the developing unit casing 118. Another shaft 130 of the developing roller 102 is connected to an outer sleeve of the developing roller 102 and is rotatable with respect to the casing 118 through a bearing 128. Around the shaft 130 within the casing 118, there is provided a seal 125 for preventing the toner from entering the bearing 128. The shaft 130 is received in a guide groove **117*a* (FIG. 11) of the stopper 117 through the bearing 115. The stopper 117 is fixed to the side frame 110 to precisely position an end portion 117*b* (against which the bearing 115 abuts) of the guide groove 117*a* at a location spaced from a shaft 129, of the photosensitive drum 101 corresponding to a predetermined distance. A driving shaft 131 is passed through the stopper 117, and a gear 124 fitted to the driving shaft 131 engages with the gear 119 fixed to the shaft 130 of the developing roller to drive it in rotation. A pulley 123 is fixed to the shaft 131 outside the side frame 110 and connected to a motor 121 through a proper means such as a belt and a gear. The numeral 122 represents a gear box. The motor 121 also drives a pulley 113 fixed to the shaft 129 of the photosensitive drum 101 through a timing belt 120, thereby driving the photosensitive drum 101**.

Figure 12:
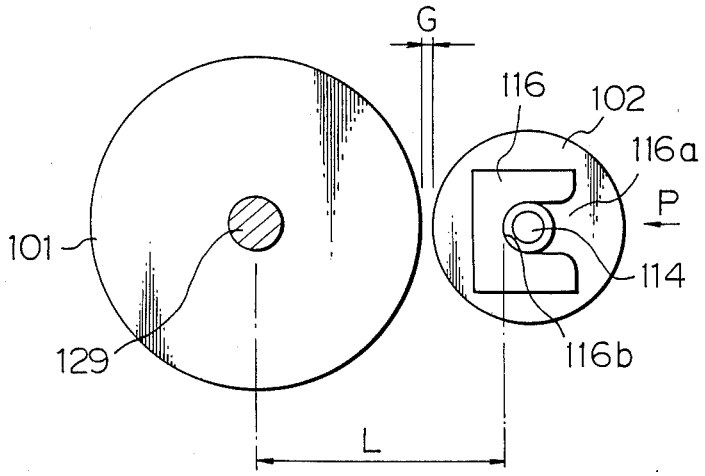
FIG. 12 is a view taken along the arrow marks 12—12 shown in FIG. 10.

Similar to the stopper 117, the other stopper 116 is provided with a guide groove **116*a* having an end portion 116*b* against which the shaft 114 of the developing roller 102 is abutted (FIG. 12). To maintain a distance "L" between the guide groove end portion 116*b* of the stopper 116 and the shaft 129 of the photosensitive drum 101 at a predetermined value, the stopper 116 is fixed with a high accuracy to the side frame 109**.

According to the above arrangement, the developing unit is inserted into a printing apparatus in a direction indicated by an arrow mark P, and the shafts 114 and 130 of the developing roller are received in the guide grooves **116*a* and 117*a* of the stoppers 116 and 117 respectively to reach the end portions 116*b* and 117*b* respectively. In this state, the developing unit is held in place such that a gap G (FIG. 12) between the surface of the photosensitive drum 101 and the surface of developing roller 102** will be maintained precisely.

A developing unit structure in which developer stored in a developer casing can now be easily replaced will be described.

Figure 13:
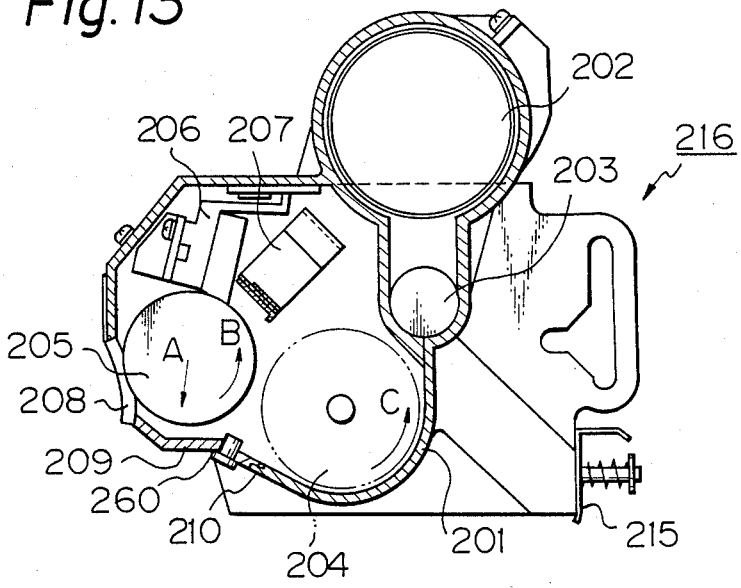
FIG. 13 is a vertical cross-sectional view of a developing unit of the present invention.
Figure 14:
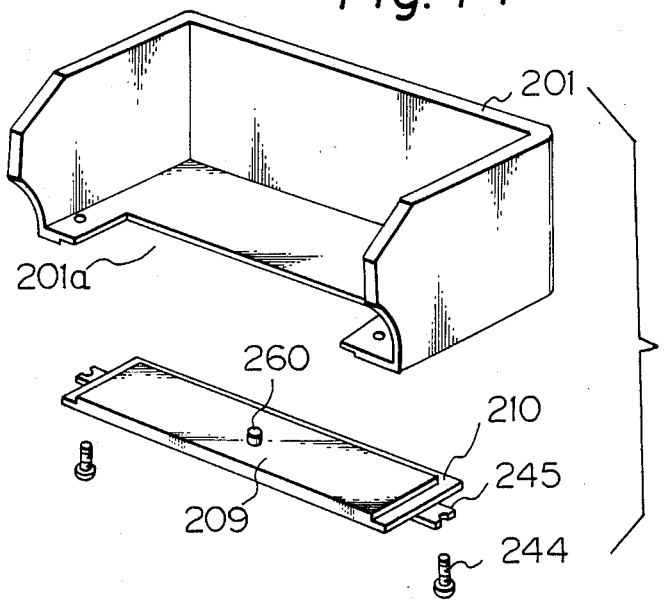
FIG. 14 is a perspective view showing a developer casing according to the present invention.

FIG. 13 is a vertical cross-sectional view showing a developing unit 216 according to the present invention. A toner cartridge 202, containing fresh toner, is disposed above a developer unit casing 201. Under the toner cartridge 202, there is provided a toner supplying roller 203 for sending the toner into the developer casing 201. A stirring roller 204 (the screw which has been described before) and a developing roller 205 are disposed in the developer unit casing 201. The stirring roller 204 rotates in a direction indicated by an arrow mark C to supply the toner (not shown) to the peripheral surface of developing roller 205. The peripheral surface of developing roller 205 includes a rotary sleeve (to be described later) which rotates in a direction indicated by an arrow mark B to supply the toner onto a photosensitive drum (not shown) through an opening portion 208. The numeral 206 represents a blade for regulating a thickness of toner on the developing roller 205, and 207 a fin for biasing the toner, which has been removed by the blade 206, in a predetermined direction and returning it toward an axis of the stirring roller 204. The developing unit 216 is removably fitted to a printer and provided with a fitting piece 215 which is fixed to a frame of the printer. A magnetic roller (to be described later) disposed inside the developing roller 205 is fixed immovably with respect to the developer casing 201. A minimum magnetic force portion of the magnetic roller is arranged to face substantially vertically downward as indicated by an arrow mark A. A cover 209 is disposed under the developing roller 205 to extend substantially the whole length of the developing roller 205. The periphery of cover 209 is formed in a step 210 (FIG. 14) to constitute a labyrinth structure which is fitted to the periphery of an opening portion 201*a*, formed at the bottom of casing 201, to completely prevent the toner from leaking. The cover 209 is fixed to the casing 201 by screws 244 through fitting pieces 245. A magnetic sensor 260, for detecting the toner concentration, is fitted to the cover 209. The magnetic sensor 260 is connected to a driving portion of the toner supplying roller 203. It is preferable to locate the magnetic sensor 260 at a position between the developing roller 205 and the stirring roller 204 as will be described later.

Figure 15:
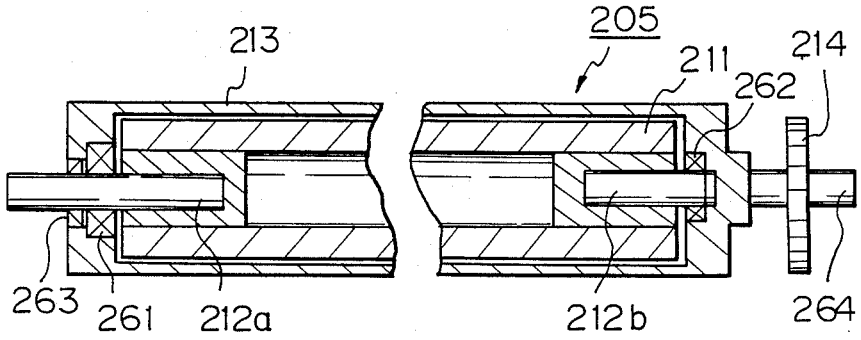
FIG. 15 is a view of a developing roller according to the present invention.

FIG. 15 is a view showing the developing roller 205. A magnetic roller 211 is magnetized at a plurality of predetermined positions and attached at both ends to fixed shafts 212*a* and 212*b*. The sleeve 213 is rotatably fitted to the fixed shafts 212*a* and 212*b* through bearings 261 and 262. The sleeve 213 surrounds the peripheral surface of magnetic roller 211. The numeral 263 represents a seal. A driving shaft 264 is fixed to the sleeve 213, and a driving gear 214 is fitted to the driving shaft 264. The shafts 212*a* and 264 and the gear 214 correspond to the shafts 114 and 130 and the gear 119 shown in FIG. 10 respectively.

Figure 16:
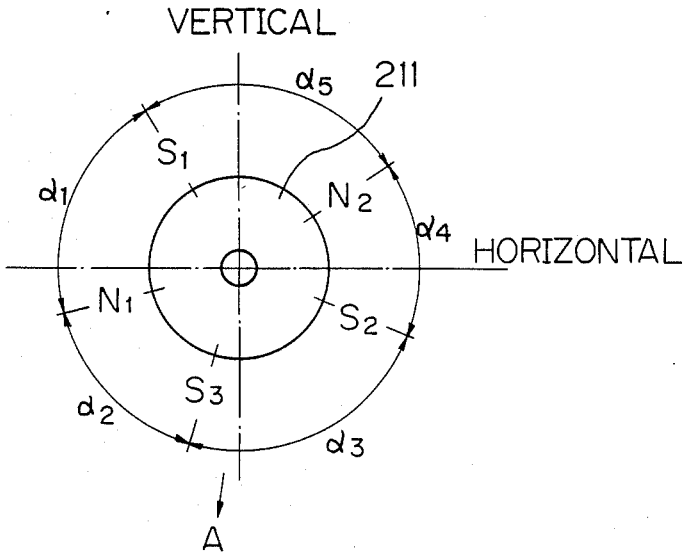
FIG. 16 is a schematic view representing a magnetizing state of a magnetic roller.
Figure 17:
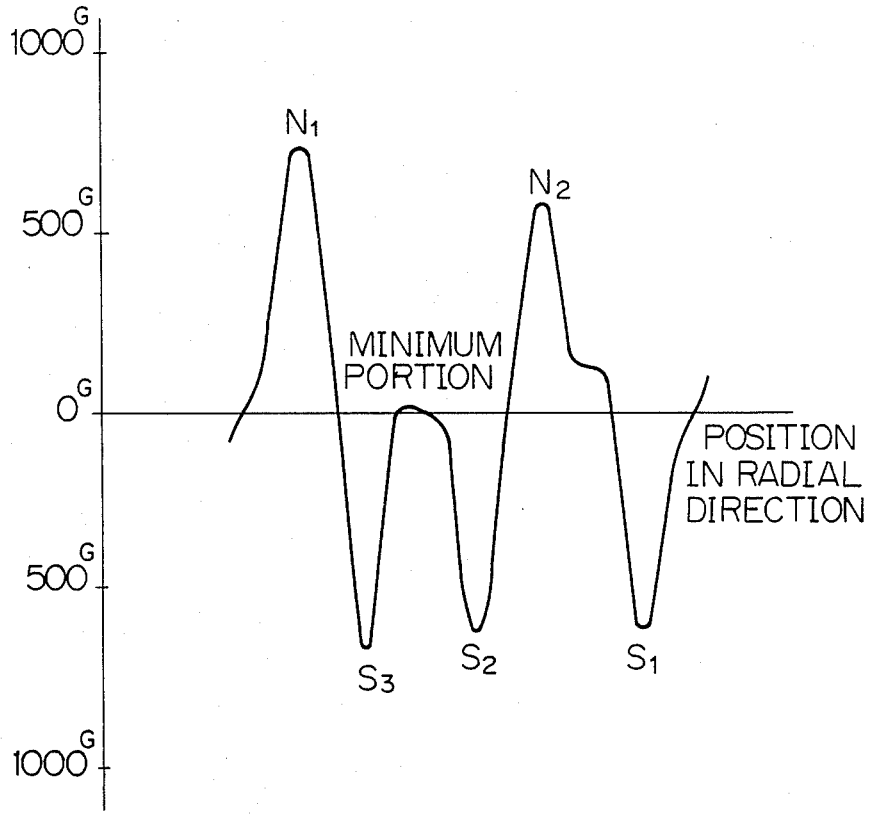
FIG. 17 is a view showing a waveform of a magnetic force of the magnetic roller.

FIG. 16 is a view showing an example of a magnetized state of the magnetic roller 211, and FIG. 17 is a waveform diagram showing a magnetic force. As shown in FIG. 16, a plurality of N and S poles ($N_1$, $N_2$, and $S_1$ to $S_3$) are magnetized on the magnetic roller 211 with predetermined intervals $\alpha_1$ to $\alpha_5$. In this case, a minimum magnetic force portion appears between the poles $S_2$ and $S_3$ as apparent from FIG. 17. The minimum magnetic force portion is caused to face substantially vertically downward as indicated by the arrow mark A (FIG. 13).

As shown in FIG. 13, the cover 109 is arranged to face the minimum magnetic force portion. When the toner is to be replaced, the developing unit 216 is removed from the printer, and the cover 209 is opened to discharge the toner at the bottom of the casing. At this time, if the sleeve 213 is rotated by manually operating the driving gear 214 (FIG. 15) of the developing roller 205, the toner remaining on the sleeve will leave the sleeve at a lower position where the magnetic force is weak thereby being discharged from the casing. Further, if the developing roller driving gear 214 is connected to the stirring roller 204 through a proper gear means, the stirring roller 204 is rotated together with the developing roller by operating the developing roller driving gear 214. Accordingly, the toner remaining at the bottom of the casing is scooped by the stirring roller 204 to be supplied to the circumference of developing roller 205, and as mentioned above, the toner leaves the roller at the lower position where the magnetic force is weak, being discharged from the casing.

Figure 18:
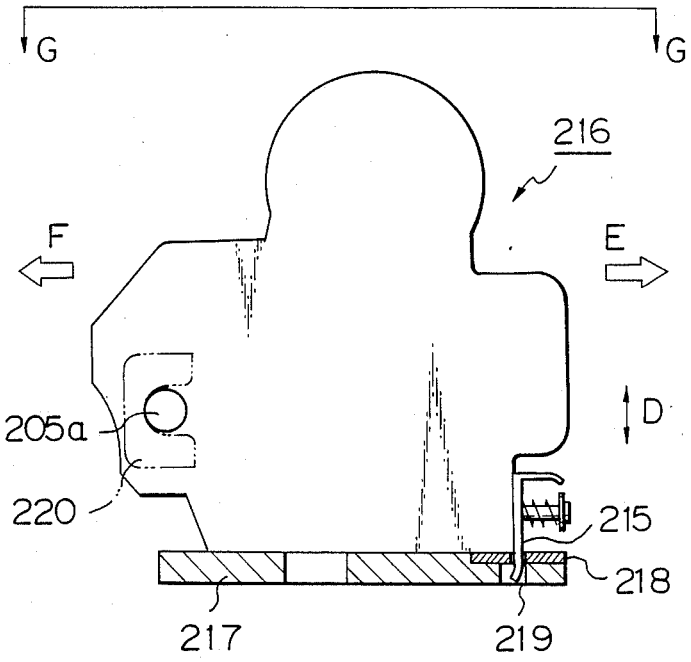
FIG. 18 is a side view illustrating a developing unit fitted to a printer.

FIG. 18 is a view showing a state wherein the developing unit 216 is fitted to a printer. The developing unit 216 is mounted on a frame 217 on the printer side. The reference mark "F" indicates an inserting direction of the developing unit, and "E" the removing direction thereof. As described above, the developing unit 216 is positioned at a predetermined location by abutting the shaft 205*a* of the developing roller against the stopper 220 on the printer side. A plate 218 having a hole 219 is disposed at an end portion of the frame 217. The fitting piece 215 of developing unit 216 is inserted into the hole 219 to fix the developing unit 216 to the printer. The developing unit 216 can move up and down in a direction indicated by an arrow mark D with the developing roller shaft 205*a* being the center of the movement.

Figure 19:
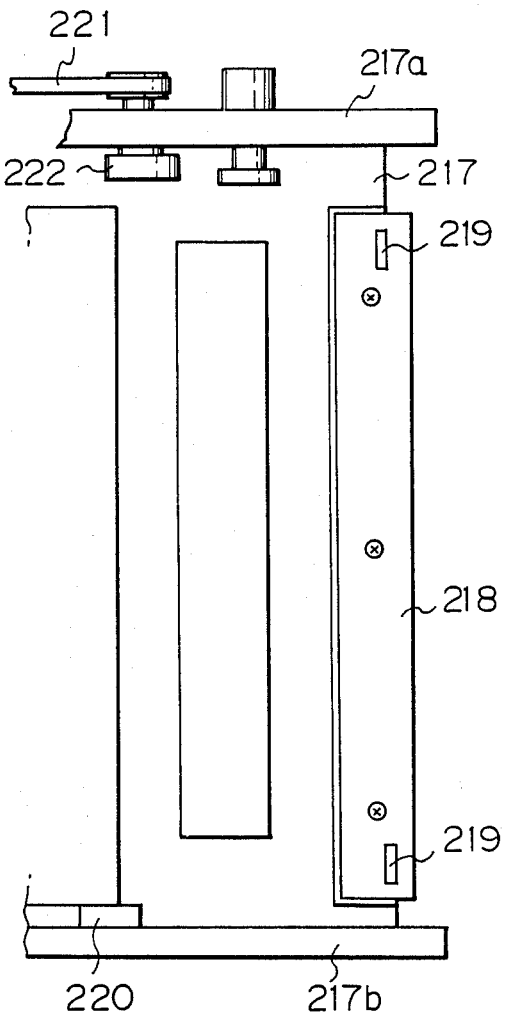
FIG. 19 is a top view showing a frame portion for fitting the developing unit.

FIG. 19 is a view taken along the arrow marks G—G showing the frame on the printer side shown in FIG. 18. The reference numerals 217*a* and 217*b* represent side frames. The numeral 222 represents a developing unit driving gear which is connected to a motor (not shown) through a belt 221.

Figure 20:
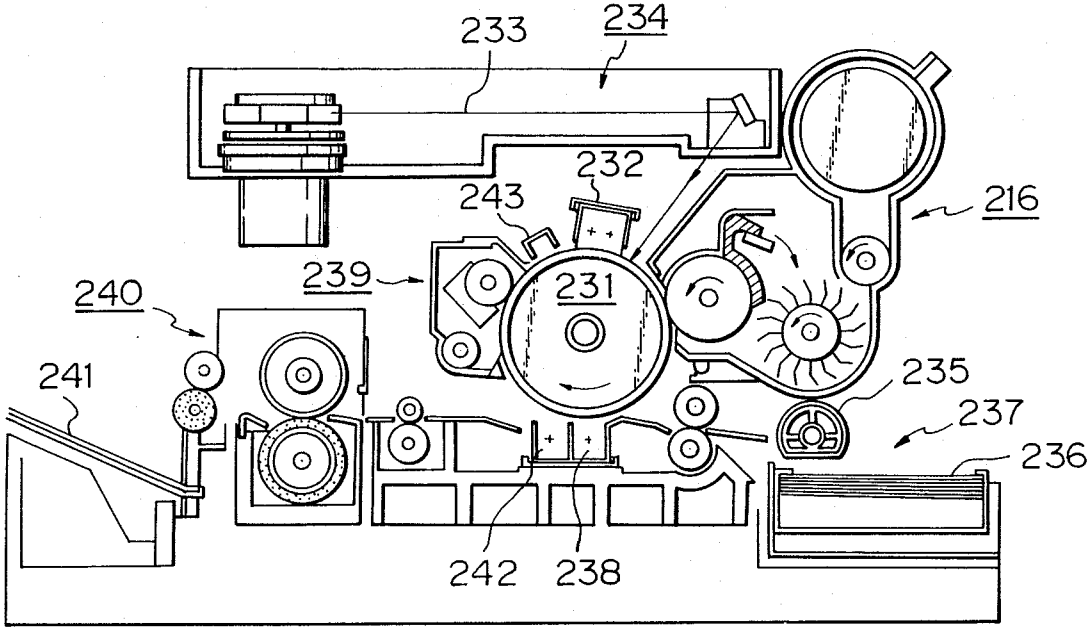
FIG. 20 is a side view showing an electrophotographic apparatus according to the present invention.

FIG. 20 is a view showing the constitution of a laser printer including the developing unit 216 described above. At a paper supplying portion 237, printing papers 236 are taken out one by one by a pick roller 235 and supplied into the printer. Around a photosensitive drum 231, there are successively disposed: a uniform electrification unit 232; a latent image forming unit 234, for forming a latent image on the photosensitive drum 231 with a laser beam 233; the developing unit 216 for developing the latent image by adsorbing toner thereto; a transfer electrification unit 238 for transferring the toner image onto the printing paper; a separation electrification unit 242; a cleaner 239; and a discharging unit 243. The numeral 240 represents a fixing unit, and 241 is a stacker for stacking printed papers.

Figure 21:
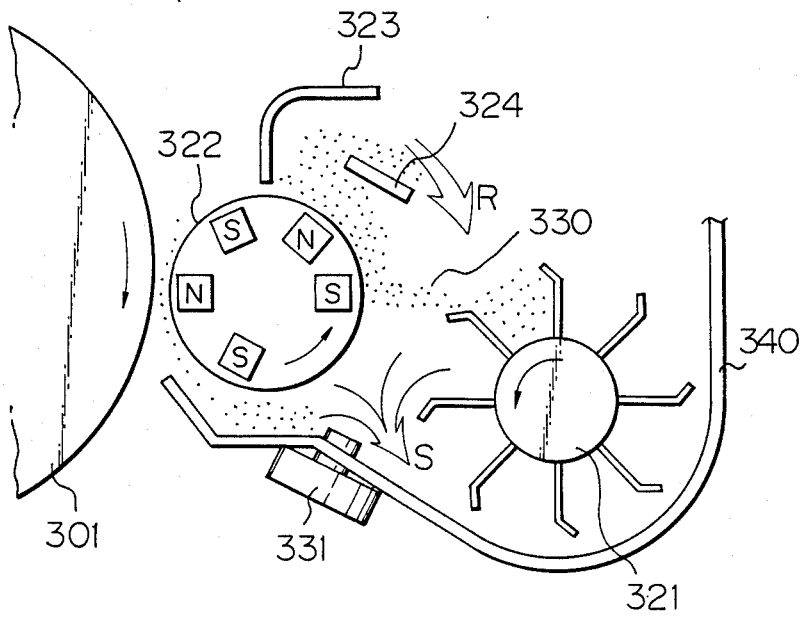
FIG. 21 is a side view showing a developing unit according to the present invention.

FIG. 21 is a side view showing the position of the toner concentration sensor 331 of the developing unit according to the present invention. To obtain a constant printing quality, toner concentration must be maintained at a constant value. To achieve this, the toner concentration sensor 331 detects the toner concentration status, and the toner is supplied or replaced if the concentration is lowered. The arrow marks R and S indicate the flow of toner 330. The numeral 301 represents a photosensitive drum; 321 a stirring roller; 322 a developing roller; 323 a blade; and 324 a toner biasing plate. The toner concentration sensor 331 is disposed near the bottom of a casing 340 and between the developing roller 322 and the stirring roller 321. At this position, the toner from the developing roller and the toner from the stirring roller are mixed and always flow uniformly. Therefore, a highly reliable toner concentration detection will be performed at this position, because erroneous detection due to the turbulence of the flow of toner or due to the non-uniformity of concentration caused by a difference of the toner consumption at various locations of the developing roller is prevented.

Figure 22:
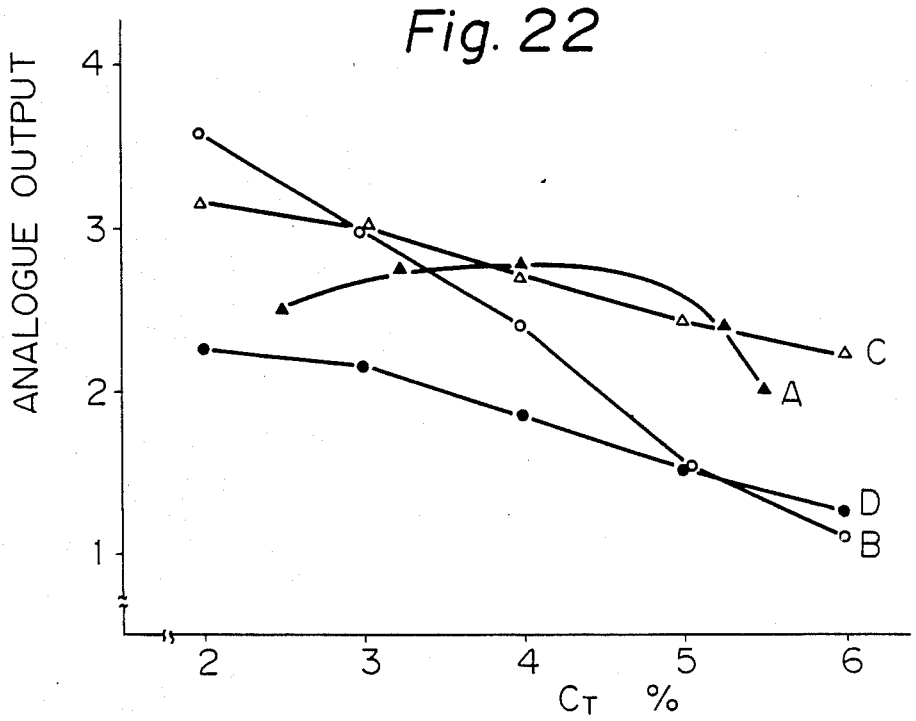
FIG. 22 is a graph showing the effect of the present invention.
Figure 23:
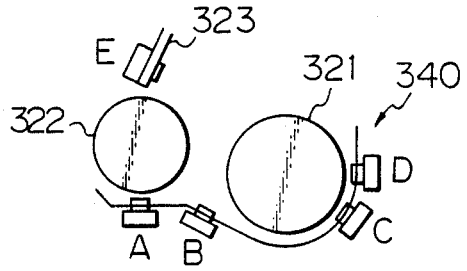
FIG. 23 is a schematic view illustrating several positions of the toner concentration sensor relative to the apparatus.

FIG. 22 is a graph showing the relationship between the toner concentration $C_T$ and an analog output of the sensor with respect to various installation positions of the toner concentration sensor shown in FIG. 23. In the graph, curves A, B, C, and D correspond to installation positions which are shown in FIG. 23 to have the same reference marks respectively.

From the graph, it is apparent:

In the case of curve B, according to the present invention, the inclination of $C_T$ to analog output is steep so that a change in the concentration can be accurately detected.

In the case of curve A, the total quantity of toner at the sensor installation position is small so that the detection may be difficult to perform.

In the cases of curves C and D, an influence of the paddles of stirring roller is large enough to greatly vary the analog output so that the adjustment may be difficult to perform. Further, the inclination of $C_T$ to analog output is decreased so that a highly accurate detection will not be realized.

At position E, the flow of toner is not stable due to blade 323 causing turbulence in the flow, so that a reliable detection will not be realized.

Therefore, the most reliable concentration detection will be performed when the sensor is arranged at the position B.

Although certain preferred embodiments have been shown and described, it should be understood that many changes and modifications may be made therein without departing from the scope of the appended claims.

We claim:

1. A developing unit for developing an electrostatic latent image formed on an image forming member, by adsorbing electrostatic powder developer, transferred by a developing roller, onto the latent image, comprising:

(a) a stirring roller having a screw provided with paddles, each having a helix angle with respect to an axis of the screw, said screw transferring said powder developer stored in a developer casing toward said developing roller and to the circumference thereof to supply said powder developer for said developing roller,
wherein said screw is provided with approximately eight paddles, each being twisted by approximately 180° over the total length of said screw;

(b) a blade for regulating a layer thickness of said powder developer which is transferred to said image forming member by said developing roller; and (c) a flow regulating plate for biasing a flow of said powder developer, which has been removed by said blade and returned to said developer casing due to the force of gravity, in a direction opposite to a direction in which the powder developer is transferred by said screw.

2. A developing unit as claimed in claim 1, wherein said flow regulation plate is provided with a plurality of fins (*7a*) each being inclined by 40° to 50° with respect to an axis of said screw.

3. A developing unit having means for positioning a developing roller of said developing unit which develops, with toner, a latent image formed on the periphery of an image forming member, said positioning means comprising:

(a) a first supporting member disposed at one end of said developing roller;

(b) a second supporting member disposed at another end of said developing roller;

(c) a pair of holding members for holding said image forming member;

(d) a first fitting member which is fixed to one of said holding members to fit said first supporting member thereto; and (e) a second fitting member which is fixed to the other holding member to fit said second supporting member thereto, wherein said developing roller, together with a developer casing containing toner, are fitted removably to said pair of holding members, said first and second fitting members being provided with grooves for guiding said first and second supporting members, respectively, such that said first and second supporting members abut against end portions of said grooves to be positioned.

4. A developing unit as claimed in claim 3 wherein said first and second supporting members each include end portions which are located outside said developer casting.

5. A developing unit, comprising:

(a) a developer casing for storing developer;

(b) a developing roller disposed in said developer casing and including a magnetic roller which is fixed immovably with respect to said developer casing, and a rotary sleeve disposed to surround the periphery of said magnetic roller,
wherein a minimum magnetic force portion of said developing roller is oriented to face substantially downward;

(c) a stirring roller disposed parallel with said developing roller and in said developer casing to scoop the developer stored at the bottom of said developer casing and to supply the developer to said developing roller; and (d) a cover of said developer casing arranged at a position facing said minimum magnetic force portion.

6. A developing unit as claimed in claim 5, wherein a peripheral portion of said cover is stepped to form a labyrinth structure to be engaged with said developer casing.

7. A developing unit as recited in claim 1, further comprising:

(d) a toner concentration sensor, for controlling a toner concentration of the developer, arranged near the bottom of said developer casing and between said developing roller and said stirring roller.

8. A developing unit for developing an electrostatic latent image formed on an image forming member, by electrostatically adsorbing powder developer, transferred by a developing roller, onto the latent image, comprising:

(a) a stirring roller having a screw provided with grooves, each groove having a helix angle with respect to the screw, said screw transferring said powder developer stored in a developer casing toward the circumference of said developing roller to supply said powder developer for said developing roller,
wherein said screw is provided with approximately eight grooves each being twisted by approximately 180° over the total length of said screw;

(b) a blade for regulating a layer thickness of said powder developer which is transferred to said image forming member by said developing roller; and (c) a flow regulating plate for biasing a flow of said powder developer, which has been removed by said blade and returned to said developer casing due to the force of gravity, in a direction opposite to a direction in which the powder developer is transferred by said screw.

9. A developing unit as claimed in claim 8, wherein said flow regulating plate is provided with a plurality of fins each being inclined by 40° to 50° with respect to an axis of said screw.

10. A developing unit as claimed in claim 5, wherein the unit is removably installed in a printing apparatus.

11. A developing unit as claimed in claim 10, wherein used developer can be discarded at the cover when the unit is removed from the printing apparatus.

12. A developing unit as claimed in claim 10, wherein the unit comprises a means for positioning the developing roller of said developing unit, said positioning means including:

(i) a first supporting member disposed at one end of said developing roller;

(ii) a second supporting member disposed at another end of said developing roller;

(iii) a pair of holding members for holding said image forming member;

(iv) a first fitting member which is fixed to one of said holding members to fit said first supporting member thereto; and (v) a second fitting member which is fixed to the other holding member to fit said second supporting member thereto.

13. A developing unit as claimed in claim 12, wherein the unit further comprises:

lock means for holding the unit on a frame of the printing apparatus, the lock means including a fitting piece which is secured to a front side face of the unit and fits into a hole provided in the frame, wherein the fitting piece is vertically movable in the hole so that the front side of the unit can move up and down with a shaft disposed at the rear side of the unit being a fulcrum of the movement.

14. A printing apparatus comprising: a photosensitive drum around which are disposed a uniform electrification unit, a latent image forming unit for forming a latent image on a surface of the photosensitive drum, a developing unit for developing the latent image by adsorbing toner developer transferred by a developing roller onto the latent image, a transfer electrification unit for transferring the latent image onto a printing paper, a separation electrification unit, a cleaner, and a discharging unit, wherein said developing unit includes:

(a) a screw provided with a plurality of members selected from one of a paddle and groove, each member having a helix angle with respect to an axis of the screw, said screw transferring the powder developer stored in a developer reservoir toward an axis of said developing roller and to the circumference thereof to supply said powder developer for said developing roller;

(b) a blade for regulating a layer thickness of said powder developer which is transferred to said image forming member by said developing roller; and (c) a flow regulating plate for biasing a flow of the powder developer, which has been removed by said blade and returned to said developer reservoir due to the force of gravity, in a direction opposite to a direction in which the powder developer is transferred by said screw.

* * * * *

UNITED STATES PATENT AND TRADEMARK OFFICE

CERTIFICATE OF CORRECTION

PATENT NO. : 4,878,088

DATED : OCTOBER 31, 1989

INVENTOR(S) : AKIO NAKANISHI ET AL.

It is certified that error appears in the above-identified patent and that said Letters Patent is hereby corrected as shown below:

Col. 2, line 26, "slope" should be --shape--.

Col. 3, line 3, "printing" should be --printer--.

Col. 4, line 4, "art" should be --prior art--.

Col. 5, line 40, "plate 7" should be --plate 7"--.

Col. 6, line 43, "roller, a" should be --roller, then a--;
line 50, delete "to".

Col. 7, line 5, "hereunder." should be --described.--;
line 23, "101. The" should be --101 and the--;
line 23, "102, and the" should be --102. The--.

Col. 9, line 51, "109" should be --209--.

Col. 10, line 24, delete "the constitution of".

Col. 11, line 52, "regulation" should be --regulating--;
line 53, delete "(7a)".

Signed and Sealed this

Thirteenth Day of November, 1990

*Attest:*

HARRY F. MANBECK, JR.

*Attesting Officer*

*Commissioner of Patents and Trademarks*